United States Patent [19]

Mucci, Sr.

[11] Patent Number: 4,825,740

[45] Date of Patent: May 2, 1989

[54] CUTTING DIES AND PUNCHES

[76] Inventor: Edmund Mucci, Sr., 16 Hemlock Rd., Livingston, N.J. 07039

[21] Appl. No.: 165,142

[22] Filed: Mar. 7, 1988

[51] Int. Cl.[4] ..... B26F 1/46

[52] U.S. Cl. ..... 83/652; 76/107 C

[58] Field of Search ..... 83/652, 653, 654, 655, 83/656, 657; 76/107 C

[56] References Cited

U.S. PATENT DOCUMENTS

| | | | |
|---|---|---|---|
| 1,030,529 | 6/1912 | Painchaud | 83/652 |
| 1,116,332 | 11/1914 | Schreiber | 83/654 |
| 1,150,147 | 8/1915 | Prime | 83/652 |
| 2,191,709 | 2/1940 | Dedrick | 83/652 |
| 2,713,902 | 7/1955 | Biss | 83/652 |
| 3,411,208 | 11/1968 | Malm | 83/652 |
| 3,469,488 | 9/1969 | Gaspari | 83/652 |
| 3,492,903 | 2/1970 | Malm | 83/652 |

FOREIGN PATENT DOCUMENTS

| | | | |
|---|---|---|---|
| 279888 | 3/1914 | Fed. Rep. of Germany | 83/652 |
| 541607 | 12/1941 | United Kingdom | 83/652 |

*Primary Examiner*—Frank T. Yost
*Assistant Examiner*—Scott A. Smith
*Attorney, Agent, or Firm*—Robert S. Salzman

[57] ABSTRACT

The invention pertains to a cutting die or punch that comprises a hardened blade and a base portion which is relatively more compressible than the blade. The compressibility of the base allows it to deform under pressure more than the blade. The compressibility of the base provides for a reduction in the requirement to adjust the blade contact with the platen in areas of irregularity. The cutting die of the invention in effect achieves a self-leveling which reduces set-up time, and increases the operational life of the blade.

20 Claims, 1 Drawing Sheet

CUTTING DIES AND PUNCHES

FIELD OF THE INVENTION

This invention relates to a cutting die or punch having an enhanced cutting life, and which requires little or no set-up time prior to the cutting operation.

BACKGROUND OF THE INVENTION

Cutting dies having a steel rule configuration have been in use since 1896, when it was accidently discovered that creasing rules being used in a printing operation could be used to cut paper under sufficient pressure. Improvements in using the rules as a cutting die were achieved by sharpening the top of the rule to a knife edge. In recent times, cutting dies have become very complex, and thousands of different dies are now in use.

Die cutting operations have similarities to printing operations, wherein the knife edge passes through the material being cut and comes in contact with a hardened platen. In actuality, however, the knife makes hard contact in various areas along the cutting edge due to the irregularities in the platen, bearings, linkages, etc. These irregularities lead to wear or flattening of portions of the knife edge. Softening the platen would not provide a solution to this problem. While a softer platen would reduce knife edge wear, it would also result in poor die cutting, which would in turn require excessive press pressures.

Knife edge wear is a serious problem in the trade, since a flattened or worn blade results in poor die cutting. Worn blades must be discarded, which is expensive from a materials replacement and labor standpoint. In addition, the replacement of the die results in down time.

To some extent, knife wear can be minimized by adjustments known in the industry as "make-ready". The make-ready adjustments comprise the application of shims under the platen or at the base of the die where cutting contact is incomplete. These make-ready adjustments, however, are at best a mediocre solution to the problem. These adjustments are labor intensive, and really do not address the problem of knife edge wear in a satisfactory manner.

Make-ready has been a procedure in the industry for a long time, thus indicating a long felt need for an improved cutting die.

BRIEF SUMMARY OF THE INVENTION

The invention features an improved cutting die or punch for the severing of materials, such as paper or corrugated board, etc. The cutting die provides a cut in the materials with little or no requirement for shim or make-ready adjustments.

The cutting die of this invention comprises a die member having a cutting portion or blade on one end which contacts a platen, and a base or bottom portion on an opposite, distal end for contacting the bed of a press.

The cutting portion of the die member is generally harder than the base portion, and has a Rockwell hardness greater then 50c, and preferrably about 55c.

The base portion of the die member is fabricated in a manner to be more compressible than the cutting portion. This greater compressibility causes the base portion to deform more readily under pressure than the cutting portion. This results in a "self-leveling" effect upon the knife blade, thus eliminating the need for adjustments, and the wearing of the knife edge along uneven contact portions with the platen.

The end result is a cutting die having an extended operational life without the need for "make-ready".

The base portion of the die is made more compressible by reducing its contact area with the press bed. A number of spaced-apart notches are fabricated in the base portion, such that its contact area is reduced approximately from 40% to 60% of its former self, i.e. a non-notched base.

The notches in the base portion are substantially uniformly spaced apart, and can be designed with several different cross-sectional configurations, such as: square, rectangular, arcuate, V-Shaped, U-Shaped, and undular (wave-like, such as a sine wave).

There are primarily four types of die cutting presses where die life and the quality of the cut product can be improved by use of the invention.

In common usage is the flat bed press where the material to be cut is placed over a flat steel rule die, and a hardened flat platen is applied with considerable pressure to the cutting die.

A second press type utilizes a flat cutting die which contacts a moving or reciprocating platen. The die is passed under a rotating cylinder having a hardened surface. On the return stroke of the platen, the cylinder is raised slightly to prevent additional knife edge wear. The cut material is removed before the return stroke.

In a third press configuration, the flat cutting die remains stationary and a guided roller with a hardened surface is caused to roll over the die which has been covered with the material to be cut. The roller (cylinder) is raised on the return, and the die cut material is removed.

The fourth die cutting operation uses a curved steel rule knife which forms part of a cylinder. The curved die revolves against a steel cylinder platen. The material to be cut passes between the rotating cylinders. A similar rotary die cutter machine utilizes curved, serrated and straight, serrated knives in a die mounting operation in which a rotary die is mounted on a revolving cylinder. The die rotates against a second cylinder usually covered with plastic. The cutting knives are allowed to penetrate slightly into the plastic. This type of machine is generally used for cutting corrugated board at high speed.

It is an object of this invention to provide an improved cutting die or punch which has extended operating life.

It is another object of the invention to provide a cutting die or punch that requires little or no "make-ready".

These and other objects of this invention will be better understood, and become more apparent, with reference to the subsequent detailed description considered in conjunction with the accompanying drawings.

DETAILED DESCRIPTION OF THE INVENTION

Generally speaking, the invention features a cutting die or punch that has an extended or enhanced operational life.

The die of the invention operates on a "self-leveling" principle, such that there is little or no need to "make-ready".

The cutting die is fashioned from standard steel rule stock, having a hardness of about Rockwell 40*c*. The sharpened blade tip is hardened to about Rockwell 55*c*. The bottom or base portion of the cutting die is reduced in contact area from about 40% to 60%, by means of notching. The reduced contact area of the base portion, along with the differential in hardness with respect to the blade, provides for a greater relative compressibility of the base portion with respect to the blade portion. This compressibility causes the bottom or base portion to deform under pressure before that of the blade portion, resulting in a self-leveling of the cutting die. In other words, the irregularities that the cutting blade may experience with respect to the platen will be nullified or evened out by the deformation of the base portion. Thus, the need to make-ready is eliminated or greatly reduced.

In several controlled production experiments, cutting dies fabricated in accordance with the invention were observed to have three times the operative life over standard dies of similar design.

For purposes of clarity and brevity, like elements will have the same designation throughout the figures in the subsequent description of the invention.

Figure 1:
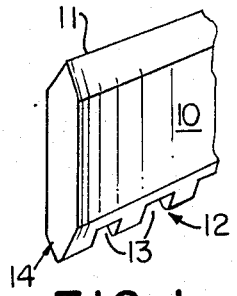
FIG. 1 is a partial perspective view of a typical die cutter of the invention.

Now referring to FIG. 1, a typical die member 10 of this invention is shown. The die member 10 has a hardened blade edge 11 for cutting materials, and which contacts a platen disposed below the materials being cut. The die member 10 has a base or bottom portion 12 which makes contact with the bed of a press. The notches 13 of the base 12 are substantially uniformly spaced-apart, and are configured with a square or rectangular cross-section. The base 12 is illustrated with a bevel or taper 14, which is optional, but believed to provide a further reduction in the contact area between the base and the press bed, as are the purpose of the notches 13.

It is this reduction in the contract are of the base 12, which provides the die with its self-leveling characteristics, and greater operational life.

Figure 1A:
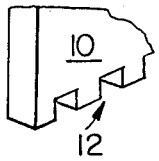
FIG. 1a is a partial perspective view of the die cutter of FIG. 1, illustrating a modified notch section.

FIG. 1*a* depicts a notched base 12 without a bevel. This type of die has also been found to provide the benefits attributed to the die member of FIG. 1.

Figure 2:
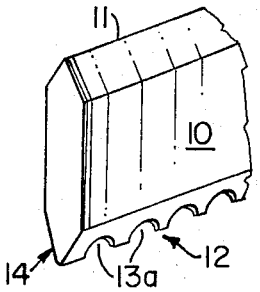
FIG. 2 is a partial perspective view of an alternate embodiment of the die cutter of FIG. 1.

Referring to FIG. 2, an alternative embodiment of the die member 10 of FIG. 1, is depicted, wherein the notched base 12 has arcuate (semi-circular) shaped notches 13*a*.

Figure 3:
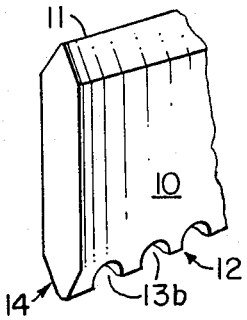
FIG. 3 is a partial perspective view of another embodiment of the die cutter of FIG. 1.

FIG. 3 illustrates yet another notch configuration, wherein die member 10 has a base 12 with notches 13*b* representing the concavities of a sine wave.

Figure 4:
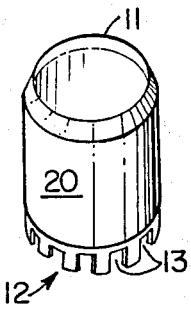
FIG. 4 depicts a perspective view of a cylindrical die cutter in accordance with the invention shown in FIG. 1.

Referring to FIG. 4, a cylindrical die punch member 20 is illustrated. The cylindrical die punch member 20 features a hardened blade edge 11 and a notched base 12 with beveled, square spaced-apart notches 13.

Figure 5:
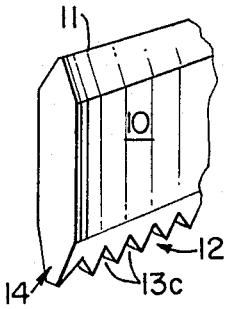
FIG. 5 is a partial perspective view of still another embodiment of the die cutter of FIG. 1.

Referring to FIG. 5, a die member 10 having a base 12 is shown with V-Shaped notches 13*c*.

Figure 6:
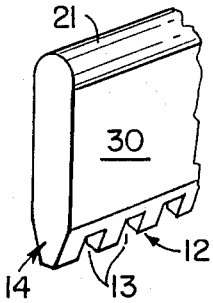
FIG. 6 illustrates a partial perspective view of a creasing rule fabricated with the inventive improvement shown in FIG. 1.

FIG. 6 illustrates a creasing rule 30 having a creasing edge 21 and a notched base 12 with square-shaped beveled notches 13.

Figure 7:
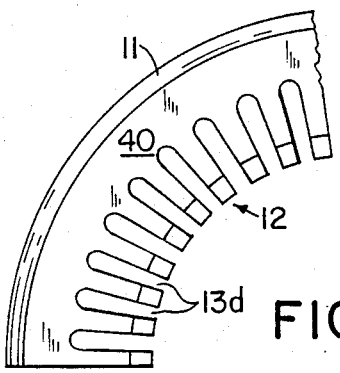
FIG. 7 is a partial plan view of a circular cutting die fabricated in accordance with the invention illustrated in FIG. 1.

FIG. 7 depicts a plan view of a circular die member 40 wherein the base portion 12 has U-Shaped notches 13*d*.

Figure 7A:
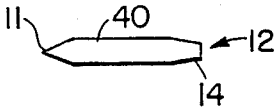
FIG. 7*a* is a side view of the cutting die depicted in FIG. 7.

FIG. 7*a* shows the side view of the circular die member 40, wherein the base 12 has a bevel 14.

All of the above die members operate on the same self-leveling principle, wherein the reduced contact area between the base and the bed of the press (not shown) causes a greater compressibility in the base 12 with respect to the blade 11, which evens out the irregularities in the contact between the blade 11 and its platen (not shown).

Having thus described the invention, what is desired to be protected by Letters Patent is presented by the appended claims.

What is claimed is:

1. A cutting die or steel rule of a given length that provides a cut in materials with little or no requirement for cutting adjustments such as the use of shims, said cutting die comprising a die member having a cutting portion on one end thereof for contacting a platen, and a base portion disposed on an opposite, distal end for contacting a press bed, said cutting portion having a relative hardness greater than said base portion, and said base portion being relatively more compressible than said cutting portion by virtue of a press bed contact area which is substantially reduced along said length which adjusts said die or steel rule to variations of press and deflection caused by high concentration cutting areas, whereby said base portion will deform more readily under pressure, wherein any irregularities in contact between said cutting portion and said platen is accommodated by the deformation of said contact area of said base portion, wherein said contact area comprises alternating contact area portions along said length.

2. The cutting die of claim 1, wherein said reduced contact area of said base portion is characterized by means defining a number of spaced-apart notches in said base portion.

3. The cutting die of claim 2, wherein said spaced-apart notches are substantially uniformly spaced-apart.

4. The cutting die of claim 2, wherein said notches are substantially square shaped in cross-section.

5. The cutting die of claim 2, wherein said notches are substantially rectangular shaped in cross-section.

6. The cutting die of claim 2, wherein said notches are substantially arcuate in cross-section.

7. The cutting die of claim 2, wherein said notches are substantially V-Shaped in cross-section.

8. The cutting die of claim 3, wherein said notches are substantially U-Shaped in cross-section.

9. The cutting die of claim 2, wherein said notches are characterized by an undular or wave-like cross-section.

10. The cutting die of claim 9, wherein said wave-like shape comprises a sine wave.

11. The cutting die of claim 2, wherein said notches are beveled.

12. The cutting die of claim 1, wherein said cutting portion has a curved cutting edge.

13. The cutting die of claim 1, wherein said cutting portion has a substantially straight cutting edge.

14. The cutting die of claim 1, wherein said die member comprises a cylinder.

15. The cutting die of claim 1, wherein said die member comprises an elongated rule.

16. The cutting die of claim 1, wherein said cutting portion is characterized by a cutting edge having a hardness approximately greater than Rockwell 50*c*.

17. The cutting die of claim 2, wherein said contact area of said notched base portion with said press bed is approximately between 40% to 60% less than a non-notched base portion.

18. In a cutting die or steel rule of a given length for cutting materials having a cutting edge portion for contacting a platen, and a base portion for contacting a press bed, the improvement characterized by said base portion being relatively more deformable under pressure than said cutting edge portion by virtue of a press bed contact area of said base portion which is approximately 40% to 60% less area than a non-notched base portion along said length which adjusts said die or steel rule to variations of press and deflection caused by high concentration cutting areas, whereby any irregularities in cutting contact between the cutting edge portion and said platen is accommodated by the deformation of the base portion wherein said contact area comprises alternating contact area portions along said length.

19. In a creasing rule of a given length for creasing materials along a crease line, the improvement characterized by a base portion being relatively more compressible than a creasing edge portion by virtue of a press bed contact area of said base portion which is substantially reduced said length which adjusts said creasing rule to variations of press and deflection caused by high concentration creasing areas, whereby any irregularities in creasing contact between said creasing edge portion and the materials to be creased are accommodated by the compressibility of the base portion, wherein said contact area comprises alternating contact area portions along said length.

20. The cutting die of claim 1, wherein said contact area comprises approximately 40% to 60% less area than a non-notched base portion.

* * * * *